US006408054B1

(12) United States Patent
Rahn et al.

(10) Patent No.: US 6,408,054 B1
(45) Date of Patent: Jun. 18, 2002

(54) MICROMACHINED X-RAY IMAGE CONTRAST GRIDS

(75) Inventors: Jeffrey T. Rahn, Mountain View; Raj B. Apte, Palo Alto, both of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/444,704

(22) Filed: Nov. 24, 1999

(51) Int. Cl.[7] ..... G21K 1/02
(52) U.S. Cl. ..... 378/154; 378/149
(58) Field of Search ..... 250/508.1; 378/145, 378/147, 149, 154

(56) References Cited

U.S. PATENT DOCUMENTS

| | | | | |
|---|---|---|---|---|
| 3,041,456 A | | 6/1962 | MacLeod | |
| 4,414,679 A | * | 11/1983 | Liebert et al. | 378/154 |
| 4,951,305 A | * | 8/1990 | Moore et al. | 378/147 |
| 5,198,680 A | * | 3/1993 | Kurakake | 250/505.1 |
| 5,234,571 A | | 8/1993 | Noeker | |
| 5,263,075 A | * | 11/1993 | McGann et al. | 378/147 |
| 5,418,833 A | * | 5/1995 | Logan | 378/154 |
| 5,557,650 A | | 9/1996 | Guida et al. | |
| 5,581,592 A | | 12/1996 | Zarnoch et al. | |
| 6,175,615 B1 | * | 1/2001 | Guru et al. | 378/149 |

OTHER PUBLICATIONS

J. Rahn, et al., "High Resolution, High Fill Factor a Si:H Sensor Arrays for Optical Imaging," Mat. Res. Soc. Symp. Proc. vol. 557, Apr. 1999, San Francisco, CA, pp. 809–814.
R.A. Street, "X–ray Imaging Using Lead Iodide as a Semiconductor Detector," Proc. SPIE vol. 3659, Physics of Medical Imaging, Feb. 1999, San Diego, CA, pp. 36–47.

* cited by examiner

*Primary Examiner*—David P. Porta
(74) *Attorney, Agent, or Firm*—Oliff & Berridge, PLC

(57) ABSTRACT

Image contrast grids include a body having openings and an x-ray absorbing material in the openings. The openings can be formed by various micromachining techniques and the x-ray absorbing material can be formed in the openings by various coating and deposition techniques. The image contrast grids can have contoured surfaces for improved focusing capabilities. The image contrast grids can remove Compton scattered x-rays in two, non-normal dimensions. The openings can be formed with fine structures that are not visible in most imaging modes.

37 Claims, 8 Drawing Sheets

MICROMACHINED X-RAY IMAGE CONTRAST GRIDS

BACKGROUND OF THE INVENTION

1. Field of Invention

This invention relates to the field of x-ray imaging.

2. Description of Related Art

X-ray radiation is widely used for medical x-ray imaging and non-destructive evaluation. X-ray radiation easily penetrates many materials and allows images to be taken based on the shadows of dense materials that absorb x-rays. X-ray imaging is used for both thick and thin tissue procedures in medical imaging radiology and fluoroscopy. Exemplary applications of x-ray imaging in non-destructive evaluation include the testing of buildings, structural members, pressure vessels, welds and airplane fuselage constructions, and the like for the presence of defects and structural integrity.

SUMMARY OF THE INVENTION

The application of x-ray imaging presents difficult technical problems. One particular problem is that the absorption of x-rays by materials at higher energies (greater than 100 keV) competes with the Compton scattering process. Compton scattering deflects x-rays through a small angle from their original trajectories. For imaging dense and/or thick materials, Compton-scattered x-rays can obscure the image formed by the absorption of direct unscattered x-rays.

FIG. 1 shows a conventional x-ray imaging system 20 configuration for imaging objects. The x-ray imaging system 20 comprises an x-ray source 22 and an image contrast grid (antiscatter grid) 24 placed between the x-ray source 22 and a detector 26. The x-ray source 22 emits x-rays 32 that impinge on an object 34 to be imaged. For example, the object 34 can be a human body. The transmitted x-rays 36 strike the surface 38 of the detector 26.

As shown in FIG. 2, the detector 26 may include a film cassette with a film 30 sandwiched between phosphors 28. As shown in FIG. 3, the detector 26 may alternatively include an electronic detector such as an a-Si detector 48 combined with a phosphor or photoconductor 28 as described in J. Rahn et al., "High Resolution, High Fill Factor a-Si:H Sensor Arrays for Optical Imaging," *Materials Research Society Proc.* 557, April 1999, San Francisco, Calif.; and R.A. Street, "X-ray Imaging Using Lead Iodide as a Semiconductor Detector,"*Proc. SPIE 3659, Physics of Medical Imaging*, Feb. 1999, San Diego, Calif., each incorporated herein by reference in its entirety.

As shown in FIG. 4, some of the non-normal x-rays 40 strike dense material 42 in the body, such as bone, and are absorbed by the dense material. However, other x-rays 44 are scattered and do not strike the dense material 42 and pass through the soft body tissue without being absorbed. These scattered x-rays are known as Compton-scattered x-rays.

The Compton-scattered x-rays 44 that do not strike dense material 42 in the object 34 adversely affect the formed image of the dense material. That is, the Compton-scattered x-rays 44 exit from the object 34 at positions that are laterally spaced from the positions at which they entered the object 34. Based on their exit locations, the Compton-scattered x-rays 44 would appear to have passed through the region of the object 34 where the dense material 42 is located, but without having been absorbed by the dense material 42.

As shown in FIG. 5, the image contrast grid 24 is provided in the x-ray imaging system 20 to absorb the Compton-scattered x-rays 44 that are not absorbed by dense material 42 in the object 34. The Compton-scattered x-rays 44 affect the darkness (contrast) of the image of the dense material 42 that is formed by the actual absorption of the x-rays 40 by the dense material 42. The image contrast grid 24 reduces the effects of the Compton-scattered x-rays 44 on the image formed by the absorption of direct x-rays by eliminating the Compton-scattered x-rays 44 that travel in a direction through the object 34 that does not point to the x-ray source 22. By eliminating the Compton-scattered x-rays 44, the image contrast is enhanced.

In general, image contrast grids are required for all "thick" tissue medical imaging procedures; i.e., procedures in which the screen is not located close (within about the thickness of the screen) to body tissue during medical imaging procedures.

Image contrast grids have been formed by laminating together foils of x-ray transparent material, such as aluminum, and x-ray absorbing material, such as lead, to form an extended sandwich structure. FIG. 6 illustrates a known sandwich structure image contrast grid 124 including aluminum foils 126 and lead foils 128 forming an alternating, parallel arrangement.

Other methods of forming image contrast grids have been described, for example, in U.S. Pat. Nos. 5,581,592 and 5,557,650, incorporated herein by reference in their entirety.

However, known image contrast grids, such as the image contrast grid 124, and the processes for forming the grids are unsatisfactory for at least several reasons. First, these processes are complicated and expensive to perform, leading to a high cost of the grids.

Second, known image contrast grids, such as the image contrast grid 124, have a relatively coarse structure that produces grid lines in the formed images. For example, to reduce this problem, the grids can be moved slightly back and forth in a direction 46 approximately perpendicular to the normal (i.e., the direction of the x-rays 36) to blur the image of the grid lines formed on the film. This movement of the grids is known as the "Bucky system." However, the Bucky system requires the imaging system to include additional components and, thus, increases the cost and complexity of the system.

Third, known image contrast grids, such as the image contrast grid 124, only remove the Compton-scattered, non-normal (off-z-axis) photons in one dimension (i.e., along either the x-axis or the y-axis). In order to provide two-dimensional photon removal using these grids, two grids, such as two of the image contrast grids 124, have been stacked with their respective foils oriented orthogonal with respect to those of the other grid. Although the combined use of two grids may improve Compton-scattered photon removal in a second direction, the cost of the imaging system is also significantly increased by the added cost of the second grid. Thus, the value of improving the performance of the imaging system by using two image contrast grids may not justify the associated added cost to achieve the improved performance.

This invention provides improved image contrast grids that can overcome the above-described problems of the known image contrast grids and the processes used to form the known image contrast grids.

This invention separately provides image contrast grids that have improved x-ray transmission efficiencies, i.e., rejection ratios, that thus reduce the required dosage of source radiation that is needed to obtain an image of an object.

This invention separately provides image contrast grids that have increased open aperture ratios.

This invention separately provides image contrast grids that can be used to form images with improved contrast.

This invention separately provides image contrast grids that have fine structures that reduce or eliminate the need to use a Bucky system during imaging.

This invention separately provides image contrast grids that remove Compton-scattered x-rays in two, co-planar dimensions, e.g., the x and y dimensions, and thus eliminate the need to use two image contrast grids simultaneously.

This invention separately provides methods of making the image contrast grids that are economical, controllable and reproducible.

This invention separately provides methods of using the image contrast grids in imaging systems for imaging objects.

Various exemplary embodiments of the image contrast grids according to this invention comprises a body forming a continuous matrix and openings. The body comprises one of a first material that is at least substantially transparent to x-rays and a second material in the openings that absorbs the x-rays without substantially scattering the x-rays. Another of the first material and the second material is disposed in the openings. The body includes a first surface where the x-rays enter the image contrast grid and a second surface opposite to the first surface where the x-rays exit the image contrast grid. The openings extend at least partially from the first surface to the second surface.

In some exemplary embodiments, the first surface of the body is machined to provide enhanced focus capabilities.

This invention also provides x-ray imaging systems to image objects that comprise an x-ray source that emits x-rays and an image contrast grid positioned such that x-rays emitted by the x-ray source pass through the object and impinge on the first surface of the image contrast grid. An image plane faces the second surface of the image contrast grid.

In various exemplary embodiments of the x-ray imaging systems according to this invention, the image contrast grid can be maintained stationary during imaging without forming grid lines on the formed image of the object. Thus, in various exemplary embodiments of the x-ray imaging system, it is not generally necessary to use a Bucky system during imaging. The image contrast grids according to this invention remove Compton scattered x-rays that pass through the object in two coplanar dimensions of the image contrast grid.

Exemplary embodiments of the methods of making image contrast grids comprise forming the body including the openings. The x-ray absorbing material can be formed in the openings or the x-ray absorbing material can be used to form the body. The openings and the x-ray absorbing material can be formed by various exemplary embodiments of the methods according this invention.

BRIEF DESCRIPTION OF THE DRAWINGS

The preferred embodiments of this invention will be described in detail, with reference to the following figures, in which.

DETAILED DESCRIPTION OF PREFERRED EMBODIMENTS

This invention provides improved image contrast grids for use in x-ray imaging applications. As described in detail below, the image contrast grids have improved rejection ratios and also reduced fill factors, i.e., increased open aperture ratios. Accordingly, the grids can improve image quality. In addition, the grids can provide increased efficiency and thus reduce the required dosage of source radiation that is needed to obtain an image of an object. In addition, the grids can have fine structures that reduce or even eliminate the need for the use of a Bucky system during imaging.

This invention also provides methods of making the image contrast grids that are economical, controllable and reproducible. The methods can provide consistent grid structures in a cost-efficient manner.

This invention also provides methods of using the image contrast grids in imaging systems for imaging objects such as bodies.

Figure 7:
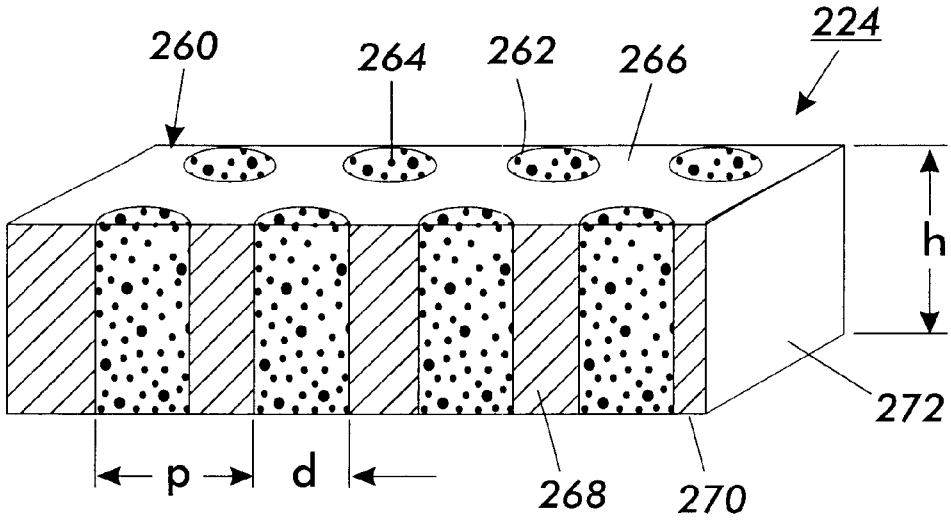
FIG. 7 illustrates an exemplary embodiment of an image contrast grid according to this invention.

FIG. 7 shows an exemplary embodiment of an image contrast, or antiscatter, grid 224 according to this invention. The image contrast grid 224 comprises a body 260 that includes a plurality of openings 262. The body 260 forms a continuous matrix. In various exemplary embodiments, the openings 262 have an elongated, generally cylindrical configuration.

An x-ray absorbing material 264 is formed in the openings 262 in the body 260. As shown, in some exemplary embodiments of the image contrast grids 224 according to this invention, the x-ray absorbing material 264 can be formed to substantially fill the openings 262. In these exemplary embodiments, the x-ray absorbing material 264 can fill the openings along the entire length of the openings 262 as shown.

Alternatively, the x-ray absorbing material 264 can fill the openings 262 only along selected portions of their length. For example, the x-ray absorbing material 264 can be formed only near the top surface 266 of the body 260.

In other exemplary embodiments of the image contrast grids 224 according to this invention, the x-ray absorbing material can be formed only on the side walls 268 defining the openings 262. For example, in such exemplary embodiments, the x-ray absorbing material can form a hollow-cylindrical configuration in the openings 262. In such exemplary embodiments, the x-ray absorbing material 264 can cover only portions of, or substantially the entire, side walls 268.

Figure 8:
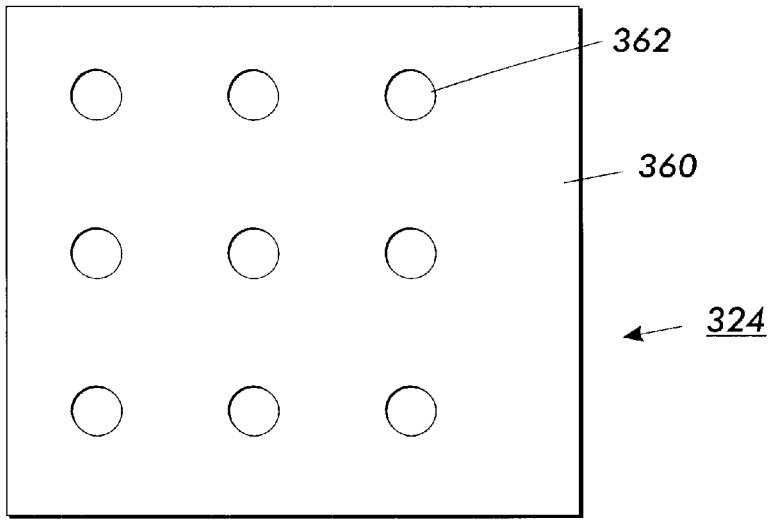
FIG. 8 illustrates an exemplary embodiment of an image contrast grid according to this invention having a regular pattern of openings.

In various exemplary embodiments of the image contrast grids according to this invention, the openings 262 formed in the body 260 have a quasi-periodic arrangement. However, in other exemplary embodiments of the image contrast grid 224, the openings 262 can be formed in different patterns. For example, in the exemplary embodiment of the image contrast grid 324 shown in FIG. 8, the openings 362 of the body 360 have a regular pattern. Other regular patterns of openings in the image contrast grids can also be formed.

Figure 9:
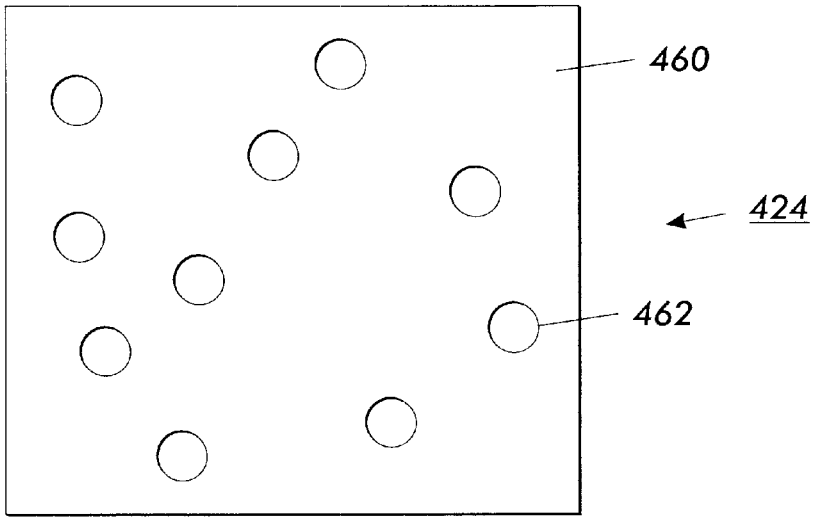
FIG. 9 illustrates another exemplary embodiment of an image contrast grid according to this invention having a random pattern of openings.

Furthermore, in other exemplary embodiments of the image contrast grids according to this invention, the openings can be randomly formed. FIG. 9 illustrates an exemplary embodiment of an image contrast grid 424 having randomly formed openings 462 in the body 460.

In the image contrast grid 224 shown in FIG. 7, the x-ray absorbing material 264 completely fills the openings 262 along their entire lengths. Thus, the x-ray absorbing material 264 forms solid columns of x-ray absorbing material in the matrix of the body 260. The columns of the x-ray absorbing material 264 have a generally cylindrical shape.

The body 260 can have any suitable configuration. A typical configuration for imaging applications is the illustrated generally rectangular shape. The body 260 includes the top surface 266, a bottom surface 270 and side surfaces 272. However, other configurations of the body 260, such as square configurations, can also be formed. The dimensions of the body 260 can be varied to provide the desired cross-sectional area A of the top surface 266 and height h.

The body 260 can comprise any suitable material that is substantially transparent to x-rays. These materials can be inorganic and/or organic. Exemplary inorganic materials suitable for forming the body 260 include aluminum, aluminum alloys such as aluminum-nickel alloys, and metal oxides such as aluminum oxide.

The body 260 can also be formed of any suitable organic material. Exemplary plastics that can be used to form the body 260 include, for example, acrylics, such as polymethylmethacrylate (PMMA), and epoxies, such as SU-8 epoxy, which is commercially available from Shell Chemical Company. The size of the openings formed in these materials may be different than those openings formed in metallic materials such as aluminum.

Other materials that can be used to form the body 260 include semiconductor materials, such as silicon. Silicon provides the advantage that it can be etched to form the openings 262 using well-known dry and wet etching techniques and other processes.

The x-ray absorbing material 264 that is formed in the openings 262 of the body 260 can be any suitable material that absorbs x-rays substantially without scattering the x-rays. The x-ray absorbing material 264 is applied in the openings 262 to absorb Compton-scattered x-rays that are scattered by the object to be imaged. Exemplary x-ray absorbing materials include lead, gold, platinum, tin, silver and mercury. Many exemplary embodiments of the image contrast grids 224 use lead as the x-ray absorbing material 264 because lead has excellent x-ray absorbing properties. In addition, lead is inexpensive and can be easily applied in the openings due to its low melting point.

The amount that the openings 262 in the body 260 of the image contrast grid 224 are filled by the x-ray absorbing material 264 can be characterized, for example, by two different factors. First, the fill amount can be characterized by the fill factor F. The fill factor F is defined as the ratio of the cross-sectional area of the x-ray absorbing material $A_{x\text{-}ray\ absorbing\ material}$ to the total cross-sectional area of the image contrast grid $A_{grid}$, in a plane parallel to the plane of the top surface 266 of the image contrast grid 224, as follows:

$$F=A_{x\text{-}ray\ absorbing\ material}/A_{grid}$$

In general, at a given fill factor F, the detail of the image formed using the image contrast grid can be improved by increasing the pitch of the openings, which is the spacing between the openings.

Second, the fill amount of the openings 262 in the body 260 can be characterized by the open aperture ratio O, which reflects the cross-sectional area of the openings 262 that is not filled with the x-ray absorbing material 264. The open aperture ratio is defined as the ratio of the total cross-sectional area of the open, non-filled portions of the openings $A_{open}$ to the total cross-sectional area of the image contrast grid $A_{grid}$, in a plane parallel to the plane of the top surface 266 of the image contrast grid 224, as follows:

$$O=A_{open}/A_{grid}$$

The open aperture ratio O and the fill factor F are related as:

$$O+F=1$$

The fill factor F, or the open aperture ratio O, affect the imaging performance of the image contrast grid 224 by affecting the amount of absorption of the x-rays by the x-ray absorbing material 264 formed in the openings. That is, because the x-ray absorbing material affects the percentage of the x-rays that pass through an object and impinge on the top surface 268 of the image contrast grid 224 in a direction normal to the top surface 268, the fill amount of the openings 262 by the x-ray absorbing material 264 affects the percentage of these normal x-rays that can be absorbed by the image contrast grid 224. Accordingly, increasing the fill factor F, or decreasing the open aperture ratio O, of the image contrast grid 224 thus increases the amount of the x-ray absorbing material 264 that can absorb the normal x-rays. Likewise, decreasing the fill factor F, or increasing the open aperture ratio O, of the image contrast grid 224 decreases the amount of the x-ray absorbing material 264 that can absorb the normal x-rays.

Figure 1:
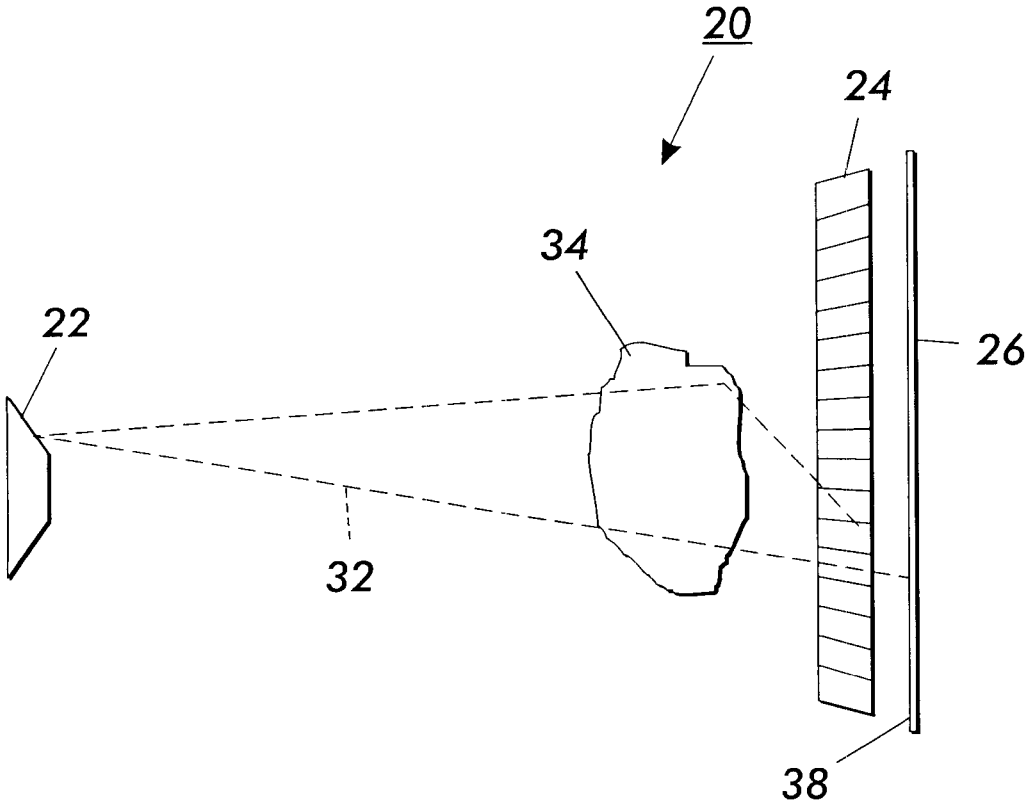
FIG. 1 illustrates an x-ray imaging system configuration.
Figure 2:
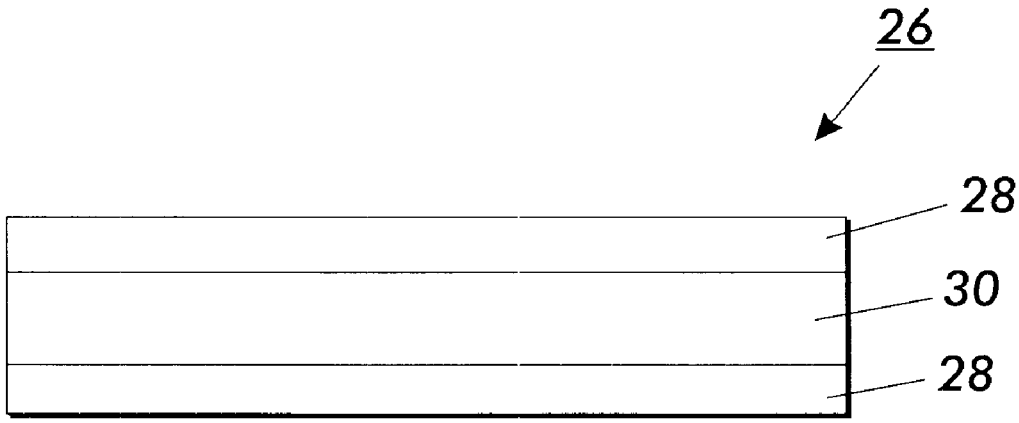
FIG. 2 illustrates an exemplary detector.
Figure 3:
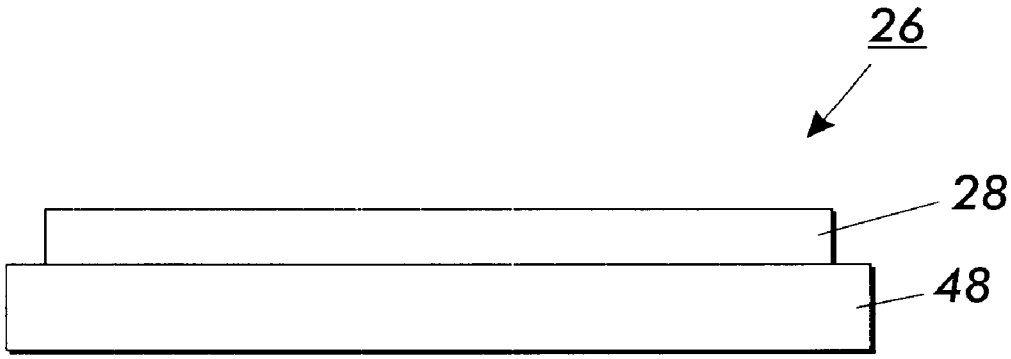
FIG. 3 illustrates another exemplary detector.
Figure 4:
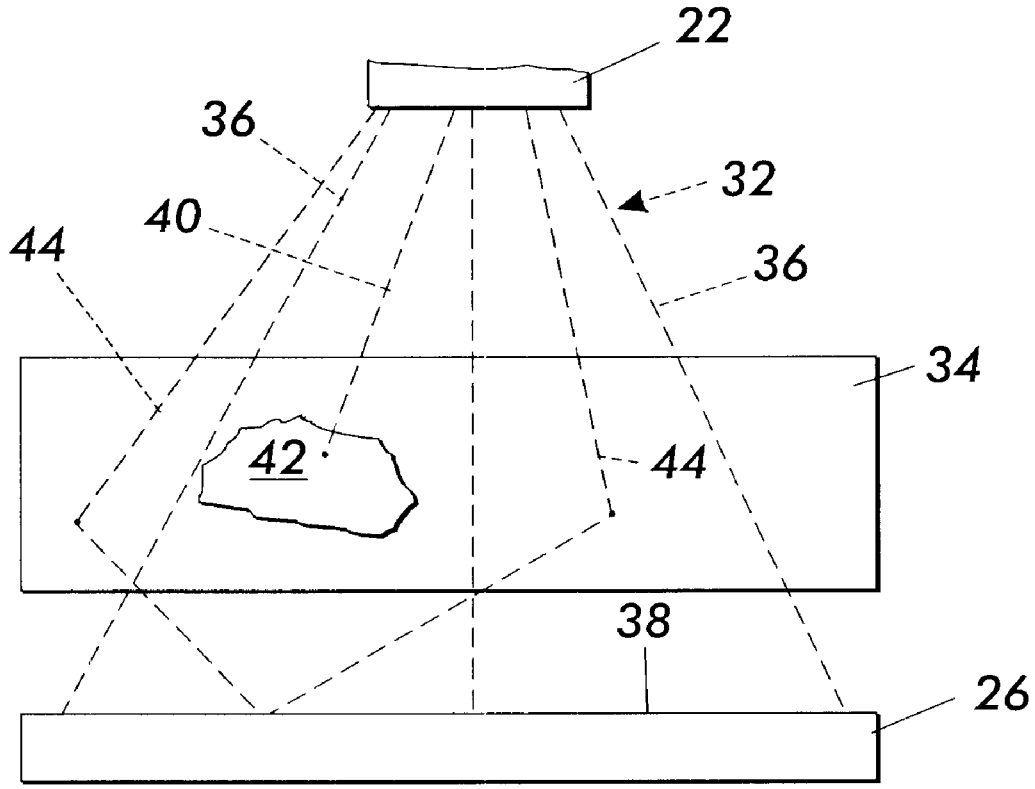
FIG. 4 illustrates the Compton scattering of x-rays by an object in an x-ray imaging system without an image contrast grid.
Figure 5:
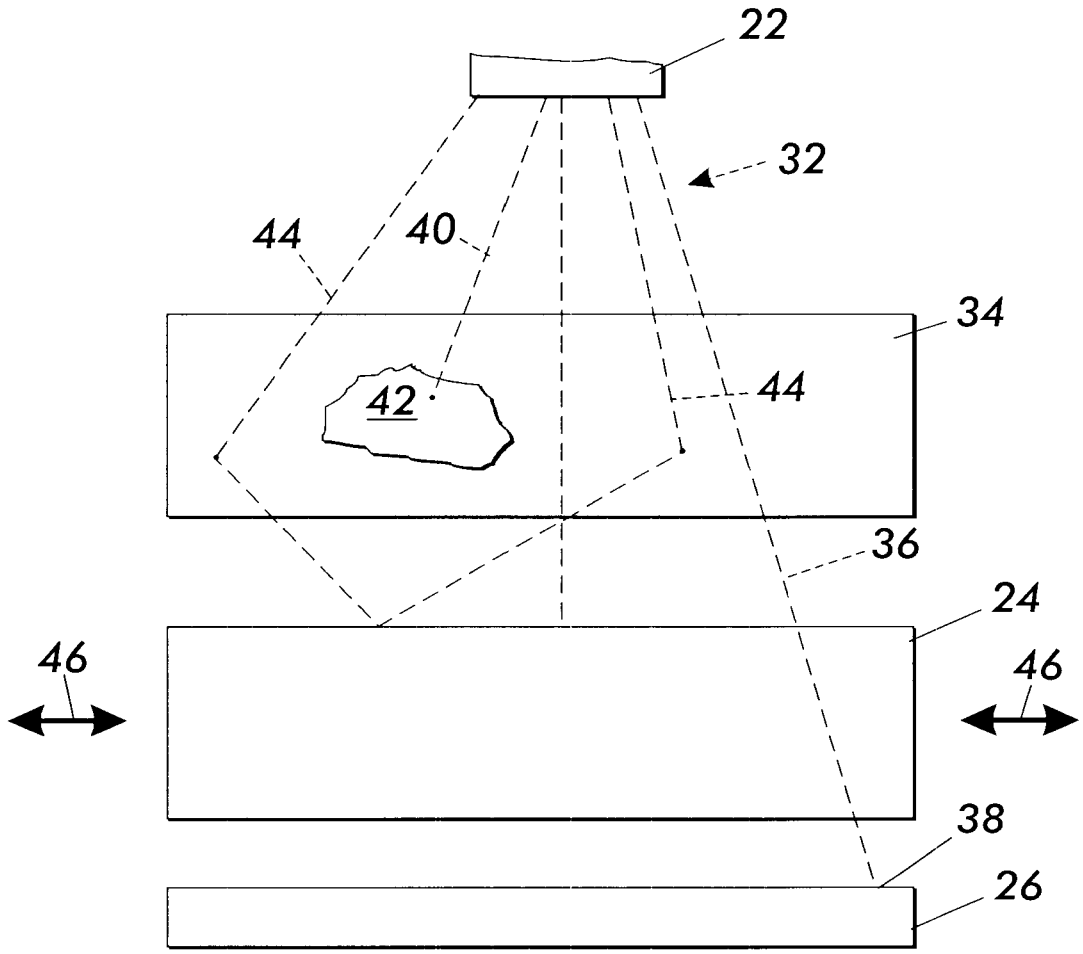
FIG. 5 illustrates the Compton scattering of x-rays by an object in an x-ray imaging system including an image contrast grid between the object and the screen.
Figure 6:
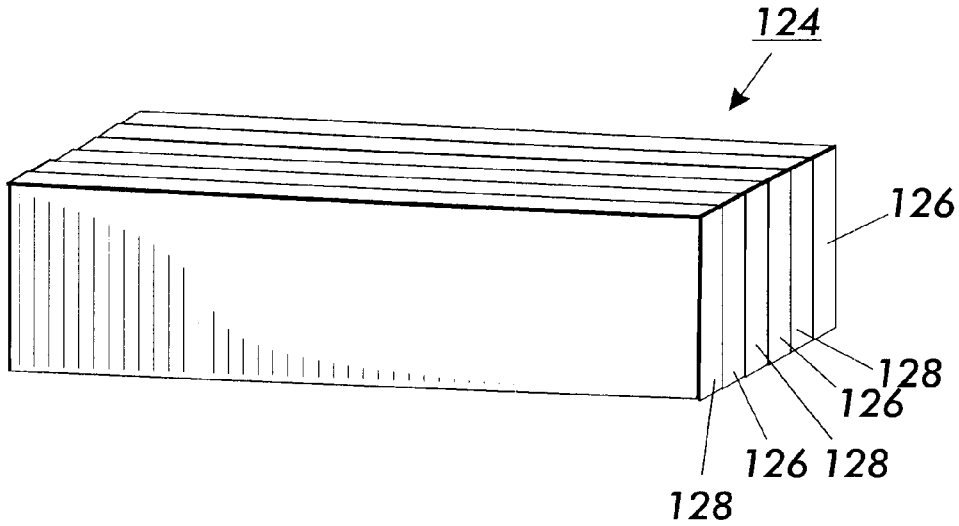
FIG. 6 illustrates a known image contrast grid structure.

In accordance with this invention, the image contrast grids 224 can provide lower fill factors F, and thus higher open aperture ratios O, than those provided by known image contrast grids, such as the image contrast grid 124 shown in FIG. 6. Open aperture ratios O approaching one are preferred. Accordingly, the image contrast grids 224 according to this invention absorb a lower percentage of the normal x-rays that impinge on them after having passed through an object to be imaged.

The columns of the x-ray absorbing material 264 shown in FIG. 7 have a diameter d and an inter-column spacing (pitch) P. A typical value for the diameter d is from about 0.1 $\mu$m to about 100 $\mu$m for body materials such as aluminum. A typical value of the pitch P is from about 0.2 $\mu$m to about 200 $\mu$m. A typical height h for the body is from about 10 $\mu$m to about 2000 $\mu$m. In various exemplary embodiments, the column diameter d satisfies the relationship:

$0.1\ \mu m < d \leqq 0.5P$.

For non-metallic materials such as PMMA, the opening diameter d can typically be from about 10 $\mu$m to about 1000 $\mu$m.

The image contrast grid 224 can be formed using various exemplary embodiments of the methods according to this invention. A first exemplary embodiment of a method according to this invention comprises patterning the material of the body using conventional photolithographic techniques. For example, the openings can be formed in the masked body by wet or dry etching techniques, as described in U.S. Pat. No. 6,177,236, incorporated herein by reference in its entirety. The etching processes can form a pattern of openings 262 in the body 260 having a staggered arrangement.

The openings 262 can have the cylindrical shape shown in FIG. 7. The openings 262 can alternatively have other cross-sectional shapes, such as square, rectangular, triangular, hexagonal or the like.

In various exemplary embodiments of the image contrast grid 224, the height of the x-ray absorbing material 264 in the openings 262 is thicker than the absorption length of the x-rays. For typical x-ray applications, a height of 0.5–1 mm of lead is sufficient. For other materials, the desired height is related to the atomic number Z of the element. In various exemplary embodiments, the desired height is inversely proportional to $Z^3$.

After the openings 262 are formed in the body material 260 by dry or wet etching or some other suitable technique, the x-ray absorbing material 264 is applied in the openings 262. An exemplary technique for applying the x-ray absorbing material 264 in the openings 262 is to dip the body 260 into a bath of a molten metal. For example, the body material, such as aluminum, can be wetted with the x-ray absorbing material, such as lead, by dipping the aluminum into a molten lead bath. During the dipping process, the lead flows into the openings 262. The melted x-ray absorbing material 264 can partially or substantially completely fill the openings. Various factors that influence the fill amount of the melted x-ray absorbing material 264 into the openings 262 include the size of the openings 262, the length of the openings 262, and the amount of time the body 260 is dipped into the melted x-ray absorbing material 264.

To enhance the flow of the x-ray absorbing material 264 into the openings 262, a flux may be utilized in various exemplary embodiments of the dipping process. Fluxes can be especially advantageous for openings that have a small diameter and/or a relatively long length, and where a high fill amount of the x-ray absorbing material 264 is desired in the openings 262.

The flow of the x-ray absorbing material 264 into the openings 262 can also be enhanced by applying pressure to the melted x-ray absorbing material 264 so that the melted x-ray absorbing material 264 is injected into the openings under pressure.

Alternatively, in other exemplary embodiments, a pressure gradient can be formed across the thickness of the body 260, to enhance the filling of the openings 262 by the x-ray absorbing material 264. For example, a low pressure can be created at a surface of the body 260, such as, for example, by a vacuum pump. An elevated pressure can be applied at an opposite surface of the body, to increase the pressure gradient across the body 260. Typically, the pressure gradient is created in the thickness direction of the body 260.

As stated above, in various exemplary embodiments, the side walls 268 of the openings 262 in the body 260 can be coated with the x-ray absorbing material 264 along only a portion of the length of the side walls 268, instead of partially or substantially completely filling the openings 262 with the x-ray absorbing material. Coating only the side walls 268 of the openings 262 with the x-ray absorbing material 264 can significantly improve the imaging performance of the image contrast grid 224, by increasing the open aperture ratio O.

Any suitable physical, chemical or electrochemical coating process can be used to coat the side walls 268 of the openings 262 of the body 260 with the x-ray absorbing material 264. Exemplary coating processes include physical vapor vacuum deposition, electrochemical deposition, chemical vapor deposition, chemical liquid deposition and the like. The coating process forms a coating on the side walls 268 that has a suitable thickness and length to provide the desired level of coverage for x-ray absorption by the image contrast grid 224.

The coating thickness of the x-ray absorbing material 264 formed on the side walls 268 of the openings 262 is preferably no greater than about the radius of the openings 262. The coatings of the x-ray absorbing material 264 on the side walls 268 of the openings 262 improves the imaging performance of the image contrast grids by providing a higher open aperture ratio O. That is, the resulting hollow coatings, having, e.g., a hollow cylinder configuration, provide a higher open aperture ratio O than is achieved by reducing the diameter d and filling the openings 262 to a greater level, to provide the same desired open aperture ratio O.

Other exemplary embodiments of the methods of forming the image contrast grids comprise coating the openings 262 in the body 260 with the x-ray absorbing material 264 by using any suitable electroplating technique. These embodiments are particularly useful for forming image contrast grids 224 having a random pattern of the openings 262.

In still other exemplary embodiments of the methods of forming image contrast grids according to this invention, an etching process, such as an anodic etching process, can be used in combination with photolithography to form the openings 262 in the body 224. For example, as described in U.S. Pat. No. 6,177,236, the body is anodically etched using a suitable etching solution to form micropores. The micropores are separated from each other by thin walls. For aluminum, the walls between the micropores comprise aluminum oxide. The micropores typically have a diameter of 0.3 $\mu$m or less.

The micropores may then be filled with the x-ray absorbing material 264 to form an image contrast grid. In other embodiments, the micropores formed by anodic etching are aggregated, and the thin walls separating the micropores are removed. Oxide etching using any suitable oxide etch solution for the material forming the body can be employed to selectively remove the thin walls after a suitable application of photoresist or other patterned masking material.

The mask and photoresist can be removed during the oxide etching step by suitable selection of the oxide etch, or can alternatively be removed in a separate step, or left.

By combining anodic etching and oxide etching processes, the resulting openings formed in the body are suitably sized to allow the x-ray absorbing material to be applied into the openings. The exemplary methods according to this embodiment can be used to form random opening patterns.

Other exemplary embodiments of the methods of forming the image contrast grids 224 comprise the use of a photoimagable material. The photoimagable material can be, for example, PMMA or SU-8. The photoimagable material is patterned with holes 262 and is coated or filled with the x-ray absorbing material 264 using any suitable coating process such as sputtering, or by chemical or electrochemical processes.

Alternatively, a seed layer of a conductive material can be deposited on the photoimagable material and any suitable x-ray absorbing material 264 can then be applied over the seed layer by any suitable process. For example, lead can be applied over the seed layer by an electroplating process.

The image contrast grids 224 with an opening diameter of less than about 10 $\mu$m also have improved scatter rejection, while leaving at most a minimal trace of the image contrast pattern on the final image. Accordingly, because the openings have a small size, the Bucky system does not need to be used during imaging for the image contrast grids 224 formed according to these embodiments.

An important aspect of imaging is achieving a suitable focus of the image. For some imaging applications, a parallel column structure as illustrated in FIG. 7 is not completely satisfactory. That is, because the x-rays that arrive at the imager are focused on the x-ray source, a focused image contrast grid having a focal length that equals the distance between the grid and the source is used.

Micromachined openings, such as the openings formed in the body material by etching processes, typically grow in a direction substantially normal to the top surface of the body. Accordingly, this opening orientation produces parallel devices having an infinite focal length.

According to this invention, it is desirable that the x-rays that pass through the object strike the top surface of the image contrast grid 224 at an angle normal to the top surface. The x-rays that strike the top surface at a normal angle have a high level of transmission through the image contrast grid 224. In contrast, the x-rays that strike the top surface at an acute angle of less than 90° are highly attenuated, i.e., absorbed.

The rejection ratio R is related to the amount of x-rays that are absorbed versus the amount of x-rays that are transmitted at a given angle of incidence of the x-rays. The rejection ratio R is given by:

$$R(\theta)=A(\theta)/T(\theta)$$

where:

$A(\theta)$ is the absorption of the x-rays at an angle of incidence of $\theta$ of the x-rays; and $T(\theta)$ is the transmission of the x-rays at an angle of incidence of $\theta$ of the x-rays.

Accordingly, the rejection ratio R decreases toward zero as the amount of x-rays that are absorbed decreases and the amount transmitted increases. The rejection ratio R increases toward infinity as the amount of x-rays that are absorbed increases and the amount transmitted decreases. The image contrast grids 224 according to this invention can provide increased rejection ratios R, corresponding to a high level of x-ray transmission and a low level of x-ray absorbance.

Figure 10:
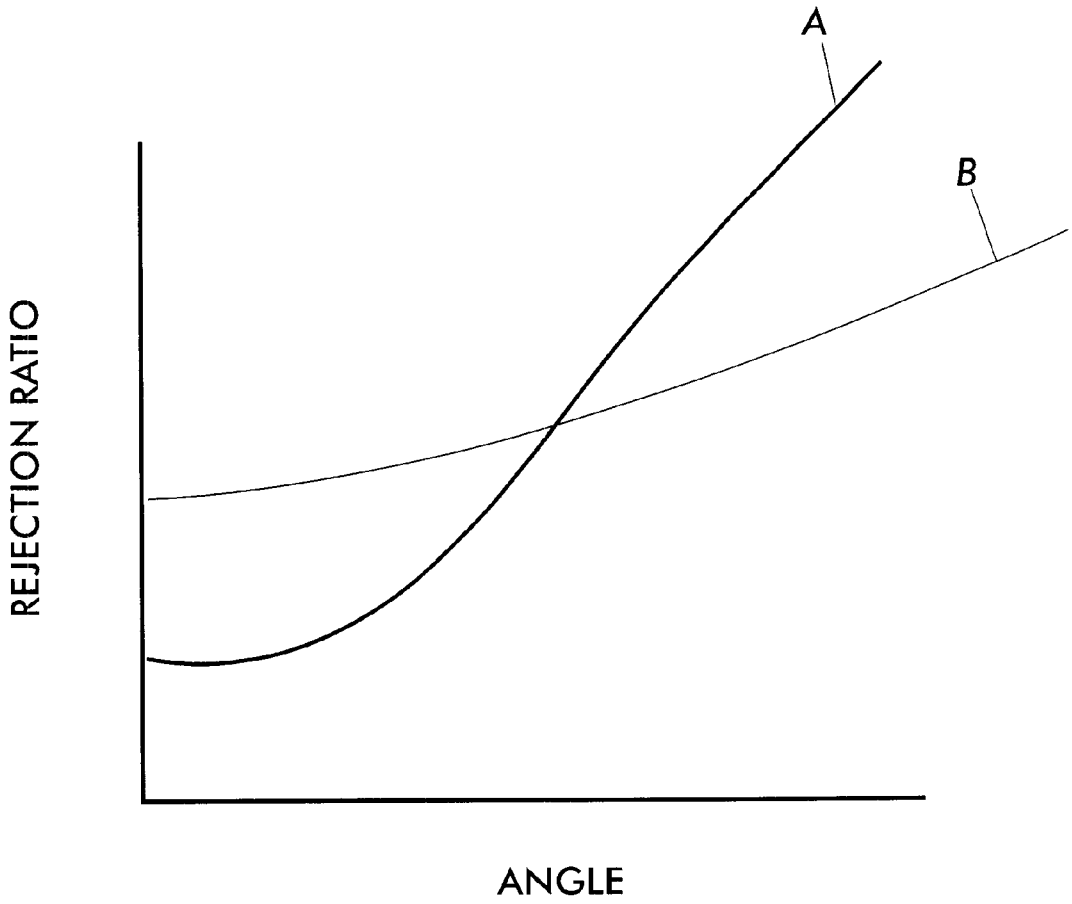
FIG. 10 illustrates the relationship between the rejection ratio and the angle of incidence of the x-rays for a known image contrast grid structure and for an image contrast grid according to this invention.

As stated above, the rejection ratio R is dependent on the angle of incidence of the x-rays on the top surface of the image contrast grid 224. FIG. 10 illustrates the relationship between the angle of incidence of x-rays on the top surface of the image contrast grid versus the rejection ratio R of the x-rays for an image contrast grid 224 according to this invention (curve A), and for a conventional image contrast grid having a sandwich structure such as the image contrast grid 124 shown in FIG. 6 (curve B). As shown, the rejection ratio R increases as the angle of incidence of the x-rays increases, reflecting a higher percentage of the x-rays being absorbed as opposed to being transmitted.

Because the image contrast grids can provide improved levels of x-ray transmission, the dose that is delivered to patients during medical imaging procedures is significantly reduced because fewer orthogonal x-rays are absorbed by the image contrast grids.

Figure 11:
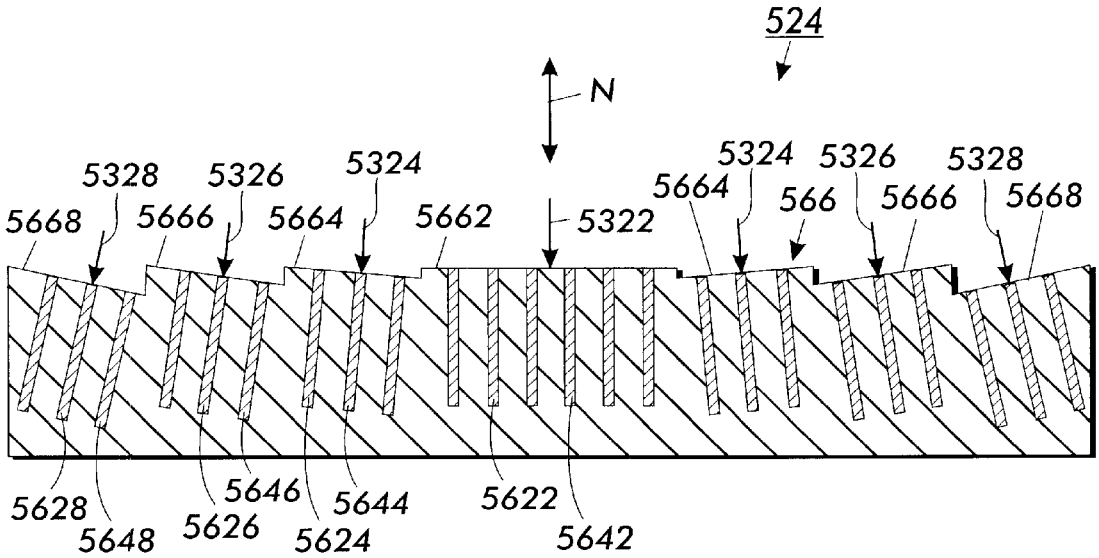
FIG. 11 is a side view of a portion of another exemplary embodiment of an image contrast grid according to this invention having a contoured top surface.
Figure 12:
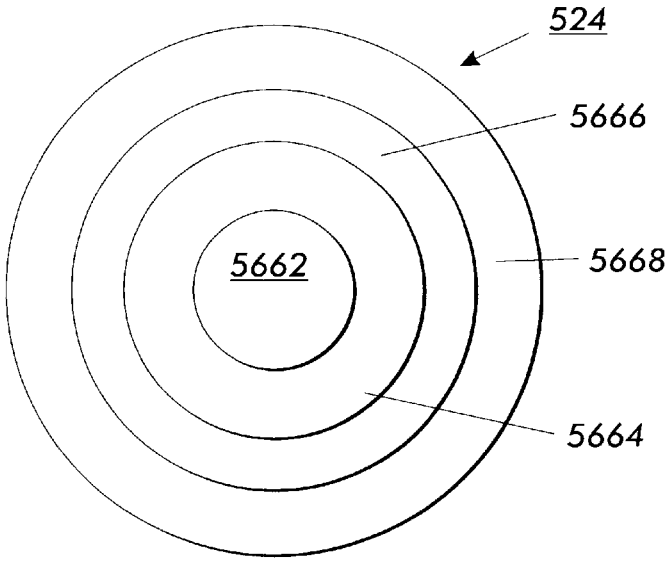
FIG. 12 is a top view of the image contrast grid of FIG. 11.

As shown in FIGS. 11 and 12, to provide the desired level of focus during imaging procedures, various exemplary embodiments of the image contrast grids 524 according to this invention have a contoured top surface 566 at which the x-rays impinge on the image contrast grid. As shown in FIGS. 11 and 12, the top surface 566 includes surface regions 5662, 5664, 5666 and 5668, each oriented at a different angle relative to the direction N; i.e., the surface regions are skewed relative to the normal N. The surface region 5662 is perpendicular to the normal N, while the surface regions 5664, 5666 and 5668 are oriented at different acute angles relative to the direction N. Consequently, the x-rays 5322, 5324, 5326 and 5328 strike each respective surface region 5662, 5664, 5666 and 5668, at an angle of about 90°. By orienting the surface regions 5662, 5664, 5666 and 5668 in this manner, the level of x-ray transmission increases, and the corresponding rejection ratio R for each of these surface regions approaches zero. Accordingly, the overall rejection ratio R of the image contrast grid 524 also increases.

According to this invention, the top surface 566 of the image contrast grid 524 can be contoured by any suitable process. For example, the top surface 566 of the body can be stamped. Alternatively, the upper surface 566 of the body can be contoured by any suitable milling procedure. For example, a milled pattern can be formed in the upper surface 566 using a milling machine, such as a computer-controlled milling machine that can provide precise patterns. Aluminum materials are relatively soft and can be easily machined and contoured.

As shown in FIG. 12, the pattern formed in the contoured top surface 566 of the body can include concentric rings. Each ring can form one of the surface regions 5662, 5664, 5666 and 5668 that is orthogonal to the focal point. The distance between the rings can be varied to provide the desired pattern.

When the body material is etched or anodized, the pores grow substantially orthogonal to the local surface orientation. Accordingly, the openings 5622, 5624, 5626 and 5628 associated with the respective surface regions 5662, 5664, 5666 and 5668 are generally parallel to each other. However, the openings 5622, 5624, 5626 and 5628 have different orientations from each other. Thus, the x-ray absorbing material 5622, 5624, 5626 and 5628 formed in the respective openings 5622, 5624, 5626 and 5628 does not form an entirely parallel structure of columns or x-ray absorbing material configurations.

The rings are formed in the top surface of the body with a desired pitch p, which is the distance between the rings. The pitch of the rings can be varied to affect the sensitivity of the grid geometry to misalignment. For a one-degree variation across the grid, the pitch is preferably smaller than the focal length f divided by 30 (i.e., p=f/30). This pitch p can be easily achieved in various exemplary embodiments of the methods of this invention, even for short focal lengths f that correspond to a small desired pitch p. Image quality considerations can, in some applications of the image contrast grids, require a finer pitch.

The various exemplary embodiments of the micromachined image contrast grids 224–524 of this invention provide advantages over known grid structures. First, the image contrast grids 224–524 according to this invention can achieve a two-dimensional antiscatter geometry.

Second, the openings, and the x-ray material formed in the openings, provide an increased open aperture ratio O. For example, the open aperture ratio of the image contrast grids can be at least about 90%. In contrast, known image contrast grids have an open aperture ratio of only about 80%.

Third, as explained above, the Bucky system typically does not need to be used during use of the image contrast grids according to this invention because the openings can be formed with sufficiently small sizes to not be visible in most imaging modes. For example, the image contrast grids can be formed with up to about 1000 openings per mm. In contrast, known image contrast grids 224–524 have less than 10 openings per mm.

However, in some applications, the particular focusing system that is used can cause image artifacts. If desired, these artifacts can be removed by using the Bucky system.

In other exemplary embodiments, the above-described methods can be used to form the body of the image contrast grid from an x-ray absorbing material rather than from an x-ray transparent material. The openings in the body are then filled with an x-ray transparent material to form a complementary structure to those of the above-described embodiments. The openings in the body can be partially filled by the x-ray transparent material. The x-ray transparent material can be formed substantially only on the walls of the openings. If the openings are left unfilled, then the body formed of the x-ray absorbing material would require an x-ray transparent support structure such as an aluminum plate. If the openings are filled with aluminum or plastic or any other suitable x-ray transparent materials having desirable structural properties, then the body will be self-supporting. Such structures are capable of high open aperture ratios, typically above 90%.

In further exemplary embodiments, the above-described embodiments can be modified by the use of casting processes to reduce the cost of making the image contrast grids, or to transfer a pattern from one material to another material.

It is contemplated that the image contrast grids 224–524 can be used in different applications. For example, another exemplary application for collimating structures for x-rays is in single photon emission computer tomography (SPECT) cameras. In these devices, the collimator allows a two-dimensional x-ray detector to function as a camera, by detecting photons based on their direction rather than just on the locations at which they strike the imager. The imaging, therefore, does not depend on a pointlike x-ray source for forming images.

In this application in SPECT cameras, a radioisotope is administered to a patient before undergoing imaging. The radioisotope has a characteristic x-ray or gamma ray emission spectrum. The radioisotope concentrates within a particular organ or structure within the patient's body, and a computed tomography approach is used to reconstruct a three-dimensional image of the concentrated region. However, SPECT camera performance is dependent on, and is often limited by, the performance of the collimator.

For SPECT cameras, the x-ray absorbing material formed in the openings will typically have a height of 5 mm to 5 cm for some medical imaging procedures, depending on the particular radioisotope that is used.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. An image contrast grid for the x-ray imaging of objects, comprising:

a body comprising a second material that absorbs x-rays without substantially scattering the x-rays, the body forming a continuous matrix and including:

a first surface where the x-rays enter the image contrast grid;

a second surface opposite to the first surface where the x-rays exit the image contrast grid; and openings that extend at least partially from the first surface to the second surface; and a first material that is at least substantially transparent to x-rays disposed in the openings, wherein the body includes a plurality of groups of the openings, the first surface of the body comprises a plurality of surface regions including a central surface region that is oriented perpendicular to a normal direction and other surface regions that are (i) disposed radially outward from the central region and (ii) each oriented at a different acute angle relative to the normal direction, the openings in each of the respective groups of openings are (i) parallel to each other and (ii) oriented perpendicular to one of the surface regions.

2. The image contrast grid of claim 1, wherein the image contrast grid removes Compton scattered x-rays in two coplanar dimensions.

3. The image contrast grid of claim 1, wherein the first material is inorganic.

4. The image contrast grid of claim 1, wherein the first material is organic.

5. The image contrast grid of claim 1, wherein the first material comprises aluminum or aluminum oxide and the second material comprises lead.

6. The image contrast grid of claim 1, wherein at least some of the openings in the body extend from the first surface to the second surface.

7. The image contrast grid of claim 1, wherein the openings in the body are elongated.

8. The image contrast grid of claim 1, wherein the first material is air.

9. An x-ray imaging system for imaging objects, comprising:

an x-ray source that emits x-rays;

an image contrast grid according to claim 1 positioned such that x-rays emitted by the x-ray source that pass through the object impinge on the first surface; and an image plane facing the second surface of the image contrast grid.

10. The x-ray imaging system of claim 9, wherein the image contrast grid is stationary during imaging, and the image contrast grid removes Compton scattered x-rays that pass through the object in two coplanar dimensions of the image contrast grid.

11. The image contrast grid of claim 1, wherein the openings in the body are randomly arranged.

12. The image contrast grid of claim 1, wherein the openings in the body are arranged in a pattern.

13. The image contrast grid of claim 1, wherein the image contrast grid has an open aperture ratio of at least about 90%.

14. The image contrast grid of claim 1, wherein the openings are substantially filled by the first material.

15. The image contrast grid of claim 1, wherein the openings are only partially filled by the first material.

16. The image contrast grid of claim 1, wherein the openings are defined by walls, and the first material is formed substantially only on the walls.

17. The image contrast grid of claim 1, wherein the openings have a diameter of about 0.3 $\mu$m and a length of about 300 $\mu$m.

18. A method of imaging an object, comprising:

emitting x-rays from an x-ray source that impinge on the object;

removing Compton scattered x-rays that pass through the object with an image contrast grid according to claim 1; and forming an image of the object on an image plane from the x-rays that pass through the image contrast grid.

19. The method of claim 18, wherein the image contrast grid is stationary during imaging of the object, and the image contrast grid removes the Compton scattered x-rays that pass through the object in two coplanar dimensions of the image contrast grid.

20. A method of making an image contrast grid, comprising:

forming a body comprising one of a first material that is at least substantially transparent to x-rays and a second material that absorbs x-rays without substantially scattering the x-rays, the body forming a continuous matrix and including:

a first surface where the x-rays will enter the image contrast grid;

a second surface opposite to the first surface where the x-rays will exit the image contrast grid; and electrochemically etching the body to form micropores separated by walls in the body;

aggregating the micropores by oxide etching to form openings in the body that extend at least partially from the first surface to the second surface; and forming another of the first material and the second material in the openings, wherein (i) when the body comprises the first material, the second material is formed in the openings, and (ii) when the body comprises the second material, the first material is formed in the openings.

21. The method of claim 20, wherein the openings have a diameter of about 0.3 $\mu$m and a length of about 300 $\mu$m.

22. The method of claim 20, wherein the another of the first material and the second material is formed substantially only on the walls of the openings.

23. A method of making an image contrast grid, comprising:

forming a body comprising a second material that absorbs x-rays without substantially scattering the x-rays, the body forming a continuous matrix and including:

a first surface where the x-rays will enter the image contrast grid;

a second surface opposite to the first surface where the x-rays will exit the image contrast grid; and forming openings in the body that extend at least partially from the first surface to the second surface; and forming a first material that is at least substantially transparent to x-rays in the openings, wherein the body includes a plurality of groups of the openings, the method further comprises machining the first surface of the body to form a plurality of surface regions including a central surface region that is oriented perpendicular to a normal direction and other surface regions that are (i) disposed radially outward from the central region and (ii) each oriented at a different acute angle relative to the normal direction, the openings in each of the respective groups of openings are (i) parallel to each other and (ii) oriented perpendicular to one of the surface regions.

24. The method of claim 23, wherein the first material comprises aluminum or aluminum oxide.

25. The method of claim 23, wherein the second material comprises lead.

26. The method of claim 23, wherein at least some of the openings formed extend from the first surface to the second surface.

27. The method of claim 23, wherein the openings in the body are elongated.

28. The method of claim 23, wherein the openings are formed in the body in a random arrangement.

29. The method of claim 23, wherein the openings are formed in the body in a regular pattern.

30. The method of claim 23, wherein the image contrast grid has an open aperture ratio of about 90%.

31. The method of claim 23, wherein the openings are substantially filled by the first material.

32. The method of claim 23, wherein the openings are only partially filled by the first material.

33. The method of claim 23, wherein the openings are defined by walls, and the first material is formed substantially only on the walls.

34. The method of claim 23, wherein the openings have a diameter of about 0.3 $\mu$m and a length of about 300 $\mu$m.

35. The method of claim 23, wherein the openings are formed by etching.

36. The method of claim 23, wherein the openings are formed by electrochemical etching.

37. An image contrast grid for the x-ray imaging of objects, comprising:

a body comprising one of a first material that is at least substantially transparent to x-rays and a second material that absorbs x-rays without substantially scattering the x-rays, the body forming a continuous matrix and including:

a first surface where the x-rays enter the image contrast grid;

a second surface opposite to the first surface where the x-rays exit the image contrast grid; and a plurality of groups of openings that extend from the first surface toward the second surface; and another of the first material and the second material disposed in the openings, wherein the first surface of the body comprises a plurality of surface regions including a central surface region that is oriented perpendicular to a normal direction and other surface regions that are (i) disposed radially outward from the central region and (ii) each oriented at a different acute angle relative to the normal direction, the openings in each of the respective groups of openings are (i) parallel to each other and (ii) oriented perpendicular to one of the surface regions.

* * * * *